US009045266B1

(12) United States Patent
Mitchell

(10) Patent No.: US 9,045,266 B1
(45) Date of Patent: Jun. 2, 2015

(54) SYSTEM AND METHOD FOR RETAINING TOWELS IN PLACE ON A BAR

(71) Applicant: April M. Mitchell, Pearl City, HI (US)

(72) Inventor: April M. Mitchell, Pearl City, HI (US)

( * ) Notice: Subject to any disclaimer, the term of this patent is extended or adjusted under 35 U.S.C. 154(b) by 206 days.

(21) Appl. No.: 13/725,223

(22) Filed: Dec. 21, 2012

Related U.S. Application Data

(60) Provisional application No. 61/631,045, filed on Dec. 27, 2011.

(51) Int. Cl.
*A47C 1/10* (2006.01)
*B65D 63/00* (2006.01)

(52) U.S. Cl.
CPC ..... *B65D 63/00* (2013.01); *Y10T 29/49947* (2015.01)

(58) Field of Classification Search
CPC ..... B65D 65/02; B65D 65/10; B65D 65/22; Y10T 29/49826
USPC ..... 24/302, 3.13; 211/88.04, 6, 16; 224/674, 675
See application file for complete search history.

(56) References Cited

U.S. PATENT DOCUMENTS

| | | | | |
|---|---|---|---|---|
| 1,829,232 | A * | 10/1931 | Morehouse | 24/576.1 |
| 4,884,305 | A | 12/1989 | Blackmon | |
| 5,611,123 | A | 3/1997 | Prizzi | |
| 5,829,832 | A | 11/1998 | Molee et al. | |
| 6,149,234 | A | 11/2000 | Daniels | |
| 6,367,638 | B1 | 4/2002 | Gougian | |
| 6,575,533 | B1 | 6/2003 | Kicos | |
| 2003/0094555 | A1 | 5/2003 | Prizzi | |

* cited by examiner

*Primary Examiner* — Christopher Besler
(74) *Attorney, Agent, or Firm* — Stout, Uxa & Buyan, LLP; Donald E. Stout

(57) ABSTRACT

A method of securing and retaining a towel or other foldable item in a folded orientation over a bar or ring, includes steps of folding the towel over a bar or ring, so that there are two approximately equal folded lengths of the towel descending from opposed sides of the bar or ring, and providing a retaining device, or strap, having two opposed ends. The method then involves wrapping the strap about the folded item, beneath the bar or ring, so that the strap surrounds and contacts each of the two folded lengths of the foldable item. The two opposed ends of the retaining strap are then secured together, to form a secured loop about the foldable item below the bar or ring, whereby the foldable item cannot be removed from the bar or ring while the secured loop of the strap is in place about the foldable item.

8 Claims, 2 Drawing Sheets

SYSTEM AND METHOD FOR RETAINING TOWELS IN PLACE ON A BAR

This application claims the benefit under 35 U.S.C. 119(e) of the filing date of Provisional U.S. Application Ser. No. 61/631,045, entitled The Towel Belt, filed on Dec. 27, 2011, which application is expressly incorporated herein by reference, in its entirety.

BACKGROUND OF THE INVENTION

This invention relates to a holding device for towels or other similar items, and more particularly to a device for holding a towel onto a bar or ring and preventing slippage of the towel onto the floor or ground.

SUMMARY OF THE INVENTION

The present invention comprises a device for retaining a foldable item in a folded orientation over a bar or ring, which comprises a belt or strap having two opposed ends, having a length of between 8 and 12 inches. A portion of a fastening device is disposed on one end of the strap, and a complementary portion of the fastening device is disposed on the opposed end of the strap, so that the two opposed ends of the strap are fastenable together to create a loop. In one embodiment, the fastening device comprises a snap, though other suitable fasteners may be used. Preferably, a surface of the strap is ornamented, and the fastening device is configured to permit the loop to be adjustable in length. This may be accomplished by arranging the strap so that the opposed end of the strap comprises two spaced complementary portions of the fastening device, to permit the length of the loop to be selectively adjustable.

In another aspect of the invention, there is disclosed a method of securing and retaining a foldable item in a folded orientation over a bar or ring, which comprises steps of folding a foldable item over a bar or ring, so that there are two approximately equal folded lengths of the foldable item, descending from opposed sides of the bar or ring, which do not contact any other structure, and wherein there is no structure disposed between the two folded lengths of the foldable item, and providing a retaining device, comprising a strap having two opposed ends. The method then involves wrapping the strap about the folded item, beneath the bar or ring, so that the strap surrounds and contacts each of the two folded lengths of the foldable item, so that the strap surrounds and contacts each of the two folded lengths of the foldable item, without contacting or enclosing any other structure. The two opposed ends of the retaining strap are then secured together, to form a secured loop about the foldable item below the bar or ring, whereby the foldable item cannot be removed from the bar or ring while the secured loop of the strap is in place about the foldable item.

An additional method step, when it is desired to remove the foldable item, preferably a fabric towel, from the bar or ring, comprises detaching the two opposed ends of the strap and removing the strap from its secured position about the foldable item.

In one preferred embodiment, the providing step includes a step of decorating a surface of the strap with an ornamental design, such as by embroidery. The providing step also includes a step of providing a strap having a length of between 8 and 12 inches, and more preferably between 9 and 10 inches. The securing step comprises engaging a male snap portion on one opposed end and a female snap portion on the other opposed end together, and further comprises selecting one of a plurality of snap portions on one of the two opposed ends, for engagement with the complementary snap portion on the other opposed end, in order to adjust the secured length of the strap loop as desired. The securing step also comprises selecting a desired length for the strap loop and adjusting a fastening system on each of the two opposed ends of the strap to achieve the desired strap loop length.

The invention, together with additional features and advantages thereof, may best be understood by reference to the following description taken in conjunction with the accompanying illustrative drawings.

DESCRIPTION OF THE PREFERRED EMBODIMENT

Figure 1:
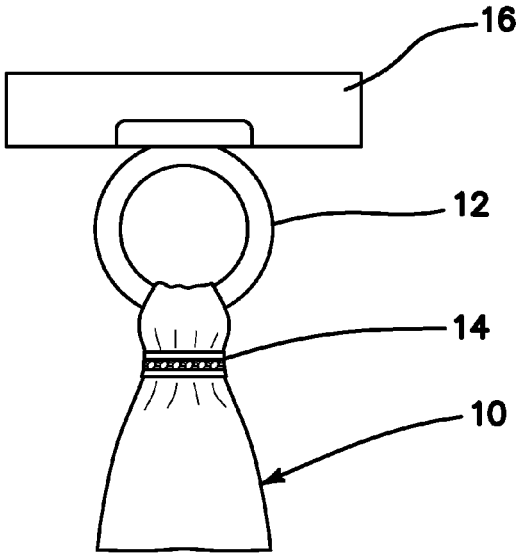
FIG. 1 illustrates a towel secured to a ring using the inventive device.

Referring now particularly to the drawings, there is shown in FIG. 1 a towel 10 which is hanging from a towel ring 12, and secured in place using a device 14 constructed in accordance with the principles of the present invention. The device 14 comprises a strap or belt, which is preferably fabricated of a suitable fabric material, but may also conceivably be fabricated of other flexible materials, such as leather. The towel ring 12 is secured to a mounting plate 16, which in turn is fastened to a wall in typical fashion.

Figure 2:
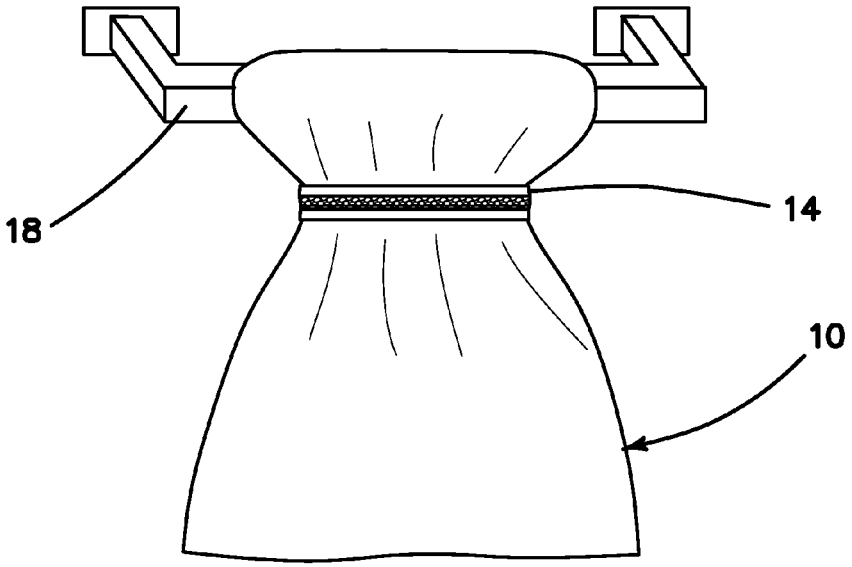
FIG. 2 illustrates a towel secured to a bar using the inventive device.

FIG. 2 illustrates a similar application for the present invention, wherein the towel 10 is hanging from a towel bar 18, and is secured in place using the inventive strap or belt 14.

Figure 3A:
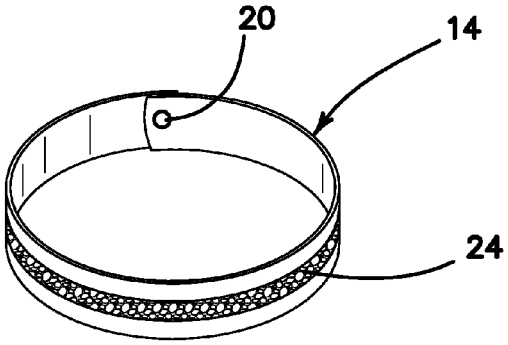
FIG. 3A is an isometric view illustrating one embodiment of the device in a secured orientation.
Figure 3B:
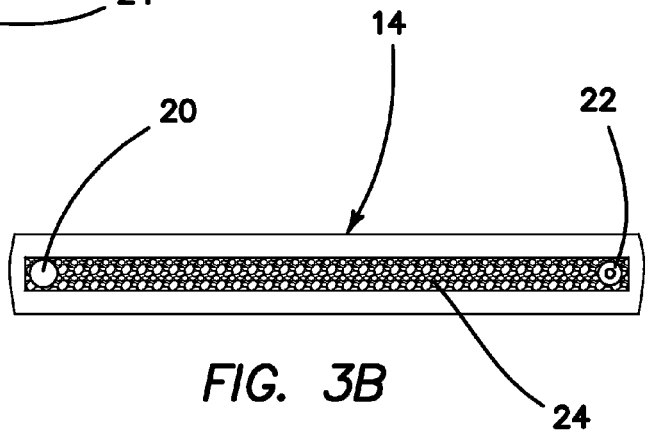
FIG. 3B illustrates the device of FIG. 3A in an unsecured orientation.

In FIGS. 3A and 3B there is shown one embodiment of the inventive strap or belt 14. FIG. 3A illustrates the device 14 in its secured orientation, while FIG. 3B illustrates the device 14 in its unsecured illustration, for storage or transport. This embodiment of the strap or belt 14 has a shorter length, and a single size when fastened, as shown in FIG. 3A. In the illustrated embodiment, a snap is utilized to fasten the strap ends together, in order to place the strap 14 in its secured orientation (FIG. 3A). Shown are a male snap member 20 on one end of the strap 14 and a female snap member 22 on the other end of the strap 14. When the snap, which may be conventional in construction, is fastened, as shown in FIG. 3A, the back side of the female snap member is visible on the inside of the secured strap 14. An ornamental design 24 may be embroidered or otherwise placed on the outer side of the strap 14, if desired, though it is not required. This design may be themed (eg to a particular holiday, such as Christmas) or merely decorative. Importantly, although snap fasteners are illustrated, any kind of fastener typically used to fasten straps together may be used, such as, but not limited to, buttons, hook and loop fasteners, or the like.

Figure 4A:
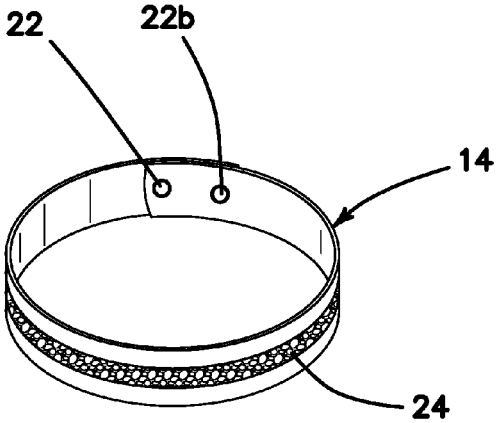
FIG. 4A is a view similar to FIG. 3A illustrating a modified embodiment of the invention in a secured orientation.
Figure 4B:
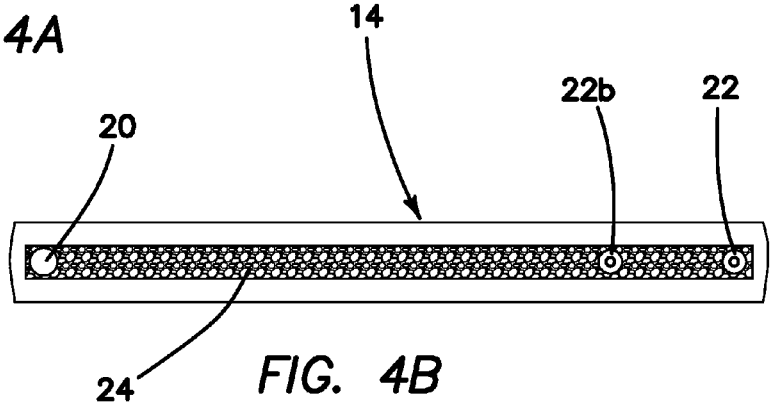
FIG. 4B is a view similar to FIG. 3B illustrating the modified embodiment of FIG. 4A in an unsecured orientation.

FIGS. 4A and 4B illustrate a modified embodiment wherein the size of the secured strap 14 may be adjusted. In this embodiment, the unsecured strap may be somewhat longer than the FIG. 3 embodiment, as illustrated, and a second female snap member 22*b* may be provided spaced from the first female snap member 22. Alternatively, a second male snap member could be provided, spaced from the first male snap member 20, if desired. When it is desired to fasten the strap ends to place the strap 14 in its secured orientation, the male fitting 20 may be inserted into either one of the female fittings 22, 22*b*, depending upon the desired length of the secured strap 14. Again, other types of fasteners may be utilized in a similar way to achieve the ability to adjust the length of the secured strap. Hook and loop fasteners, notably, are inherently adjustable, only limited by the respective lengths of each of the hook and loop strips provided.

In one currently preferred embodiment, the longer embodiment, as illustrated in FIGS. 4A and 4B is about 9¼ inches. The inventive device is preferably between about 8 and 12 inches in length, depending upon application and whether the length of the secured strap is adjustable.

In practice, the inventive system is applicable to any situation wherein it is desired to be able to hang the towel, blanket, or other such item from a bar or ring so that it cannot be pulled off by a toddler or child, or otherwise fall to the ground or floor because of slippage, wind, tugging, or the like. To use the inventive belt or strap 14, the towel 10 is looped over the ring 12 or bar 18, as shown in FIGS. 1 and 2, and as is well known, so that the two ends of the towel hang freely. At this point, the strap or belt 14 is wrapped around the towel 10, below the ring 12 or bar 18, as shown in FIGS. 1 and 2, so that the strap 14 extends only around the two hanging ends of the towel, and no other structure, such as a frame or the like. The two ends of the strap 14 are then secured together, as shown in FIGS. 3A and 4A, using the snaps 20, 22 or 20, 22*b*, or other suitable fastener, as discussed above.

With the strap 14 disposed in its secured orientation about the towel 10, the towel can be tugged on and used as desired to dry one's hands, or other purposes, without any chance of it coming free of the bar or ring it is hanging over. This is, of course, the sides of the towel on both sides of the bar or ring are secured together by the strap 14, making slippage from the bar or ring impossible. When it is desired to remove the towel from the bar or ring, the strap may be removed by simply unfastening the snap 20, 22 to separate the strap ends, and then removing the strap from its position about the towel.

While the device 14 is shown in connection with towel rings or bars, in kitchen or bathroom settings, for example, it may also be used to secure a towel to the handle of a stroller, for example, or on the handle of exercise equipment, bicycles, or any other suitable purposes.

Accordingly, although exemplary embodiments and methods according to the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A method of securing and retaining a foldable item in a folded orientation over a bar or ring, comprising:

folding the foldable item over the bar or ring, so that there are two approximately equal folded lengths of the foldable item, descending from opposed sides of the bar or ring, which do not contact any other structure, such that only the bar or ring is disposed between the two folded lengths of the foldable item;

providing a retaining device, comprising a strap having two opposed ends;

wrapping the strap about the folded item, beneath the bar or ring, so that the strap surrounds and contacts each of the two folded lengths of the foldable item, without contacting or enclosing any other structure; and securing each of the two opposed ends of the retaining strap together, to form a secured loop about said foldable item below the bar or ring;

whereby the foldable item cannot be removed from the bar or ring while the secured loop of the strap is in place about the foldable item;

wherein the foldable item comprises a fabric towel.

2. The method as recited in claim 1, and further comprising a step of detaching the two opposed ends of the strap and removing the strap from its secured position about the foldable item.

3. The method as recited in claim 1, wherein the providing step includes a step of decorating a surface of the strap with an ornamental design.

4. The method as recited in claim 1, wherein the strap has a length of between 8 and 12 inches.

5. The method as recited in claim 4, wherein the strap has a length of between 9 and 10 inches.

6. The method as recited in claim 1, wherein the securing step comprises engaging a male snap portion on one opposed end and a female snap portion on the other opposed end together.

7. The method as recited in claim 6, wherein the securing step further comprises selecting one of a plurality of snap portions on one of the two opposed ends, for engagement with the complementary snap portion on the other opposed end, in order to adjust the secured length of the strap loop as desired.

8. The method as recited in claim 1, wherein the securing step comprises selecting a desired length for the strap loop and adjusting a fastening system on each of the two opposed ends of the strap to achieve the desired strap loop length.

* * * * *